US008661563B2

(12) United States Patent
Evans et al.

(10) Patent No.: US 8,661,563 B2
(45) Date of Patent: Mar. 4, 2014

(54) ELBOW PAD AND UPPER BODY GARMENT WITH ELBOW REINFORCEMENT

(75) Inventors: Lindsay M. Evans, Talent, OR (US); Tam'ra Perry, Central Point, OR (US); Martin L. Flora, Ashland, OR (US); Maria-Paz S. Santo, Medford, OR (US)

(73) Assignee: Massif Mountain Gear Company, LLC, Ashland, OR (US)

( * ) Notice: Subject to any disclaimer, the term of this patent is extended or adjusted under 35 U.S.C. 154(b) by 279 days.

(21) Appl. No.: 13/249,328

(22) Filed: Sep. 30, 2011

(65) Prior Publication Data

US 2012/0144542 A1 Jun. 14, 2012

Related U.S. Application Data

(60) Provisional application No. 61/422,720, filed on Dec. 14, 2010.

(51) Int. Cl.
*A41D 13/08* (2006.01)

(52) U.S. Cl.
USPC ..... 2/16

(58) Field of Classification Search
USPC ..... 128/881
See application file for complete search history.

(56) References Cited

U.S. PATENT DOCUMENTS

| | | | | |
|---|---|---|---|---|
| D58,551 | S | 8/1921 | Dalton | |
| D59,502 | S | 10/1921 | Meacham | |
| 1,513,609 | A * | 10/1924 | Ladner et al. | 223/72 |
| D68,120 | S | 9/1925 | Spencer | |
| D96,079 | S | 7/1935 | Anderson | |
| 2,589,636 | A * | 3/1952 | Smith | 2/459 |
| D243,724 | S | 3/1977 | Schaefer | |
| 4,272,850 | A * | 6/1981 | Rule | 2/24 |
| D306,511 | S | 3/1990 | Jones | |
| 5,127,106 | A | 7/1992 | Aldridge | |
| D353,254 | S | 12/1994 | Welch | |
| D374,329 | S | 10/1996 | Wilde | |
| D402,424 | S | 12/1998 | Jackson | |
| D431,345 | S | 10/2000 | Newkirk, Jr. | |
| D464,790 | S | 10/2002 | Townes et al. | |
| 6,651,254 | B1 | 11/2003 | Chang | |
| D526,467 | S | 8/2006 | Kent | |
| 7,171,695 | B2 | 2/2007 | Braun | |
| D555,878 | S | 11/2007 | Bay | |
| 7,636,948 | B1 | 12/2009 | Crye et al. | |

(Continued)

FOREIGN PATENT DOCUMENTS

DE 102 61 359 A1 7/2004

OTHER PUBLICATIONS

U.S. Appl. No. 13/028,682, filed Feb. 16, 2011, Evans et al.
U.S. Appl. No. 13/225,844, filed Dec. 14, 2011, Munter et al.

*Primary Examiner* — Katherine Moran
(74) *Attorney, Agent, or Firm* — Dority & Manning, P.A.

(57) ABSTRACT

An elbow pad is provided for an upper body garment with a sleeve portion having a shoulder end and a wrist end. The elbow pad includes padding material and a substantially J-shaped preferential fold line. The preferential fold line is configured so that the padding material bends along the preferential fold line to cup the wearer's elbow. The elbow pad may have multiple layers. The elbow pad may be attached to an upper body garment, and may be done so as to fill an opening in a sleeve portion of the garment.

18 Claims, 9 Drawing Sheets

(56) References Cited

U.S. PATENT DOCUMENTS

| | | | | |
|---|---|---|---|---|
| D620,231 | S | 7/2010 | Parker | |
| D622,937 | S | 9/2010 | Bay | |
| D640,041 | S | 6/2011 | Flora et al. | |
| D641,137 | S | 7/2011 | Evans et al. | |
| D641,138 | S | 7/2011 | Santo et al. | |
| D654,664 | S | 2/2012 | Evans et al. | |
| 2006/0277651 | A1* | 12/2006 | Razzaghi et al. | 2/81 |
| 2009/0249529 | A1 | 10/2009 | Rodriguez et al. | |
| 2010/0212061 | A1 | 8/2010 | Luciano | |
| 2010/0212062 | A1 | 8/2010 | Seguin et al. | |

* cited by examiner

ELBOW PAD AND UPPER BODY GARMENT WITH ELBOW REINFORCEMENT

CROSS-REFERENCE TO RELATED APPLICATION

The present application is based on and claims priority to U.S. Provisional Application 61/422,720 having a filing date of Dec. 14, 2010, which is incorporated by reference herein.

TECHNICAL FIELD

The present disclosure relates to an elbow pad and an upper body garment with reinforcement for a wearer's elbow.

BACKGROUND

Various garments have employed reinforcement at areas prone to additional wear or pressure. Such reinforcements need to balance competing interests such as comfort, durability, air and moisture permeability, and thermal suitability, etc. For example, an elbow pad for a garment that provides superior abrasion resistance may not provide comfort for a wearer in a warm environment in terms of seam location, thickness, permeability, etc. Garments having multiple similar layers at the elbow may provide comfort but insufficient strength and durability.

Military garments provide particular challenges due to the high performance requirements and multiple needs that must be met by each component of a garment. Military garments may also have flame or fire resistance, wicking, and/or stretchability needs for wearers in extreme environments. Military wearers may wear garments for longer durations or with other equipment atop or below, including heavy protective covering, body armor, headgear, or the like. Also, where a wearer is to be involved in shooting a rifle or the like, having a stable shooting platform at the elbow area may be desired. Therefore, having an elbow pad that is reliably located at an elbow area in a repeatable fashion and that provides a stable platform for an extended elbow holding a rifle barrel may be important to some wearers.

Accordingly, there is a need for an improved upper body garment, suitable for military wearers but not limited to such persons, and that meets multiple performance and wear criteria, including elbow reinforcement.

SUMMARY

The present disclosure is directed generally to elbow pads and upper body garments having reinforced elbow sections. According to certain aspects of the disclosure, an elbow pad is provided for an upper body garment with a sleeve portion having a shoulder end and a wrist end. The elbow pad includes padding material configured in an elbow pad shape, and a substantially J-shaped preferential fold line. The preferential fold has a first section extending from a first end of the padding material for placement facing the shoulder end toward a second end of the padding material for placement facing the wrist end. The preferential fold line curves in a central area of the padding material and has a second section extending to a forward side of the padding material. The preferential fold line is configured so that the padding material bends along the preferential fold line to cup the wearer's elbow. Various options and modifications are available.

For example, the preferential fold line may comprise a first preferential fold line and the each elbow pad may include a second preferential fold line, the second preferential fold line extending from a first end of the padding material to the second end of the padding material and crossing the second section of the first preferential fold line, with the second preferential fold line being configured to further cup the wearer's elbow. Also, the preferential fold line or lines may be formed in part by stitching penetrating the padding material. The padding material may have a convex shape extending outward in the central area.

If desired, the padding material may have an inner layer, an intermediate layer, and an outer abrasion resistant layer. If so, the intermediate layer of the padding material may be an open cell foam, or may be other padded material. At least one of the padding material layers may be permeable by at least one of air or moisture. The padding material layers may also be attached together in a non-planar, cupped orientation so as to enhance a convex shape. Further, if desired, at least one of the padding material layers may be at least one of flame resistant or fire resistant.

According to other aspects of the disclosure, an upper body garment is provided with reinforcement for a wearer's elbow, the garment including a torso portion, two sleeve portions, and two elbow pads. Each sleeve portion has a shoulder end attached to the torso portion and a wrist end extending distally from the shoulder end. Each sleeve portion is formed of a sleeve material in a substantially tubular shape, and the sleeve material defines a location for the wearer's elbow. Each elbow pad is attached to a respective sleeve portion at the location for the wearer's elbow. Each elbow pad has a substantially J-shaped preferential fold line. The preferential fold line has a first section extending from a first end of the elbow pad facing the shoulder end of the sleeve portion toward a second end of the elbow pad facing the wrist end of the sleeve portion. The preferential fold line curves in a central area of the elbow pad and has a second section extending to a forward side of the elbow pad. The preferential fold line is configured so that the elbow pad bends along the preferential fold line to cup the wearer's elbow. As above, various options and modifications are possible.

For example, the preferential fold line may comprise a first preferential fold line and each elbow pad may include a second preferential fold line. The second preferential fold line extends from a first end of the elbow pad to the second end of the elbow pad and crosses the second section of the first preferential fold line. The second preferential fold line is configured to further cup the wearer's elbow. If desired, the preferential fold lines or lines may be formed in part by stitching penetrating the elbow pad. The elbow pad may have a convex shape extending outward in the central area.

The sleeve material may define an opening at the elbow location and the elbow pad may be sized larger than the opening. The opening may be defined by edges extending circumferentially around the opening. The elbow pad may be attached to the sleeve portion underneath the edges so as to fill the opening with the elbow pad. The elbow pad may also be attached to the sleeve portion underneath the opening in a non-planar, cupped orientation so as to enhance a convex shape.

If desired, each elbow pad may include an inner layer, an intermediate layer, and an outer abrasion resistant layer. If so, the intermediate layer of the padding material may be an open cell foam, or may be other padded material. The elbow pad layers may be attached together in a non-planar, cupped orientation so as to enhance a convex shape. If desired, at least one of the elbow pad layers may be at least one of flame resistant or fire resistant.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
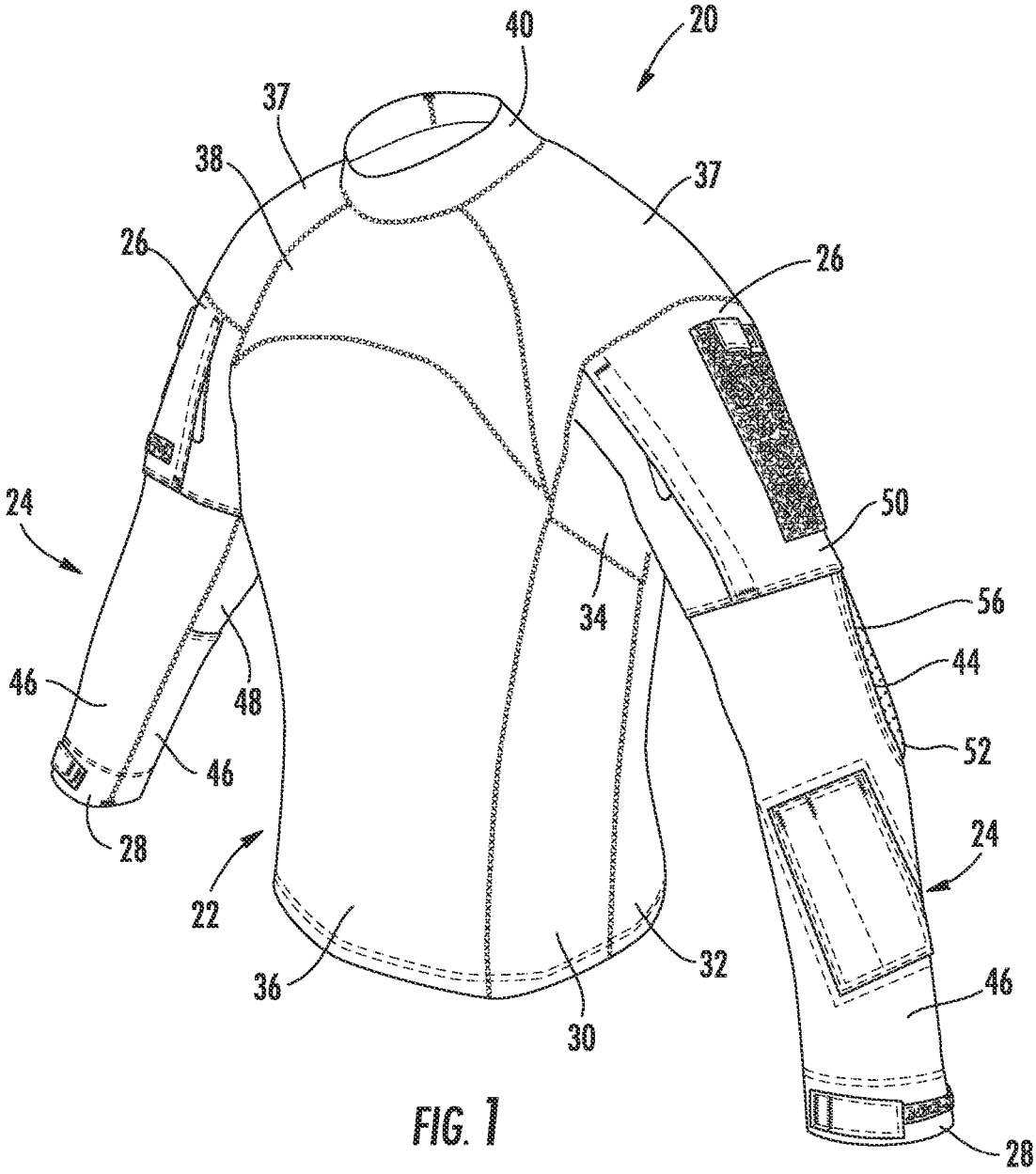
FIG. 1 is a front perspective view of an upper body garment with reinforced elbow areas.
Figure 2:
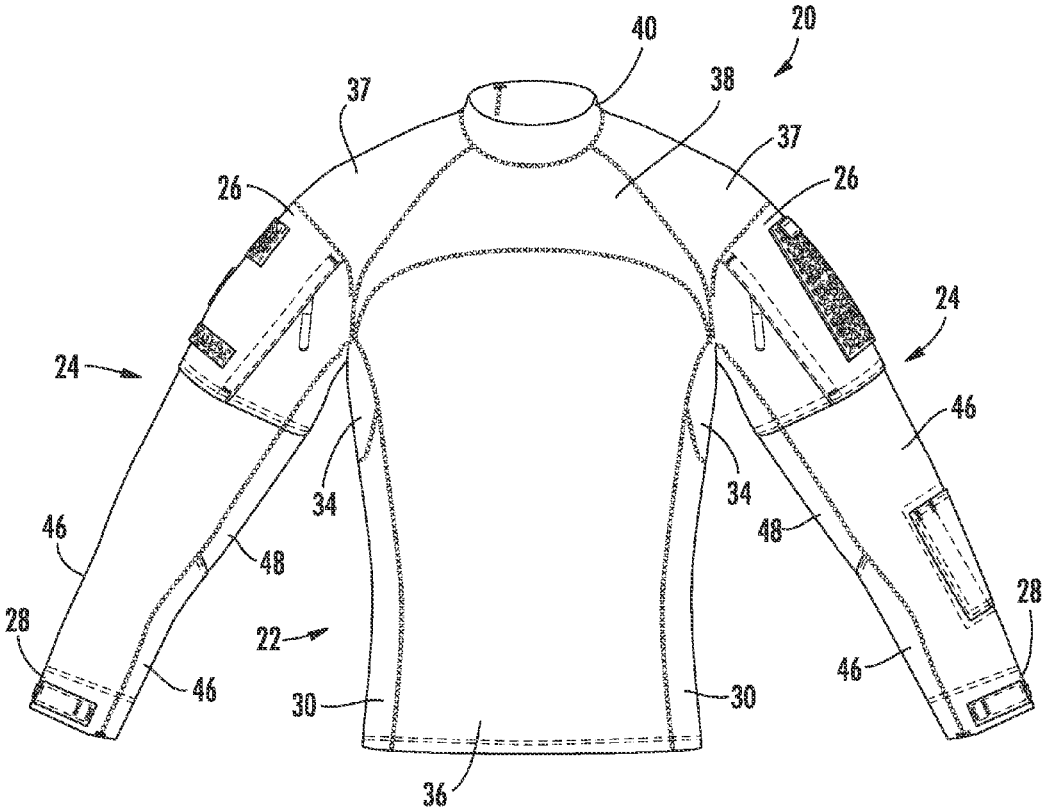
FIG. 2 is a front view of the garment of FIG. 1.

Repeat use of reference characters in the present specification and drawings is intended to represent the same or analogous features or elements.

DETAILED DESCRIPTION

Reference now will be made in detail to embodiments of the upper body garment with reinforced elbow areas, one or more examples of which are illustrated in the drawings. Each example is provided by way of explanation, not limitation. In fact, it will be apparent to those skilled in the art that various modifications and variations can be made in the present disclosure without departing from the scope or spirit of the invention. For instance, features illustrated or described as part of one embodiment can be used with another embodiment to yield a still further embodiment. Thus, it is intended that the present disclosure covers such modifications and variations as come within the scope of the appended claims and their equivalents.

FIG. 1 shows an upper body garment 20 incorporating aspects of the present disclosure. As shown, garment 20 is a shirt, but it should be understood that the upper body garment as discussed and claimed herein could be any garment suitable for wearing on an upper body portion. Therefore, the present disclosure could also be directed to an undershirt, a shirt, a top layer garment such as a sweatshirt or jacket, etc., and upper body garment should not be restrictively interpreted to mean only a shirt.

Upper body garment 20 includes a torso portion 22 and two sleeve portions 24. Each sleeve portion 24 has a shoulder end 26 attached to torso portion 22 and a wrist end 28 extending distally from the shoulder end.

As shown, torso portion 22 and sleeve portion 24 may be made from various pieces of fabric, stitched together. The fabric pieces may have different properties depending on the location on the wearer's body. For example, a first fabric may be used on torso side and underarm sections 30,32,34 and sleeve portions 24. A second fabric may be used on torso chest sections 36,37,38, collar section 40, and torso back section 42. The fabrics may be stretchable, breathable, wicking, and flame resistant. The collar, chest and back sections may differ from the side and sleeve sections by providing more wicking and breathability. The side and sleeve sections may provide enhanced flame and heat protection, which may be useful if the wearer is also wearing body armor providing additional torso protection but leaving the arms more exposed.

As shown, stitching on garment 20 is intended to be comfortable to wearers in various environments, including warm weather locales. Therefore, stitching may be avoided at locations where it could be uncomfortable, in particular in combination with the wearing of other garments or body armor, and where perspiration and dusty conditions might cause discomfort. Pockets provided may be low-profile as well, providing functionality and comfort. Loop connector portions (such as Velcro®) may be provided for receiving patches providing name, rank, unit, flag, etc., information. Pockets may be zipper closed for security, and there may be gathers at sleeve ends, waist areas, etc. Any zippers, pulls, pockets or other add-ons may provide thermal or flame resistance. Infra-red identification elements may be provided and may be made selectively concealable as well.

It should be understood that the above optional structures may be useful in the disclosed upper body garment, in particular for military use. However, many variations and options are possible with such a garment according to the present disclosure. Thus, many different shirt and other upper body garments may benefit from the present disclosure regardless of garment structure and optional features.

Figure 3:
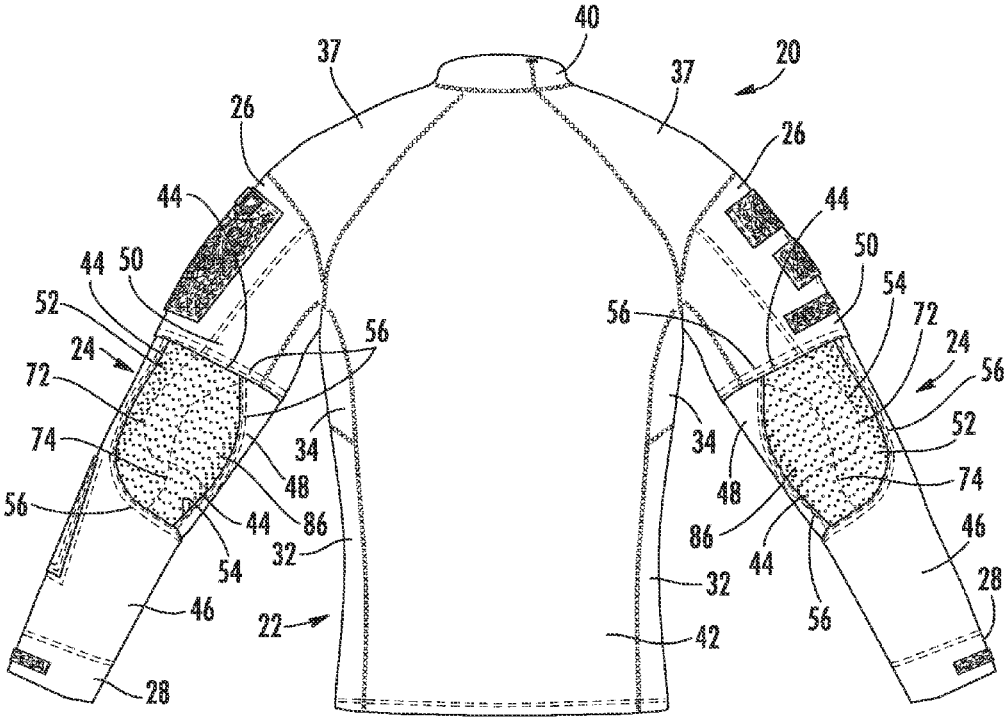
FIG. 3 is a rear view of the garment of FIG. 1.
Figure 4:
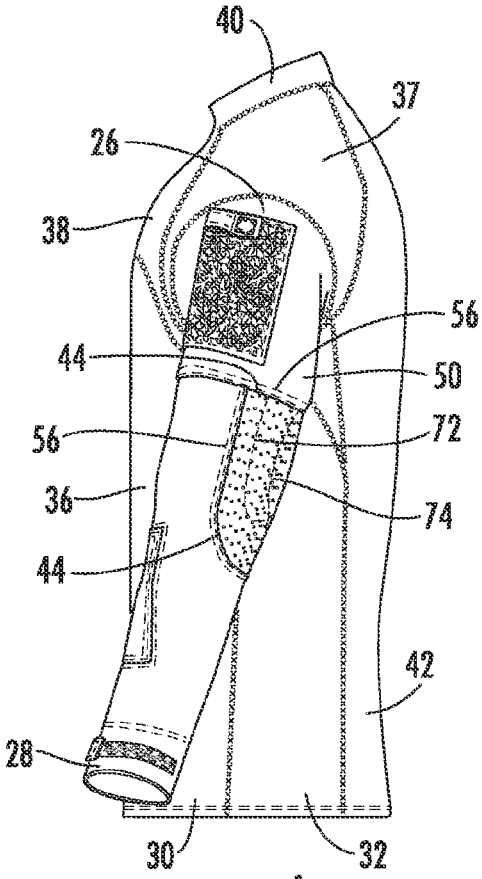
FIG. 4 is a left side view of the garment of FIG. 1.
Figure 5:
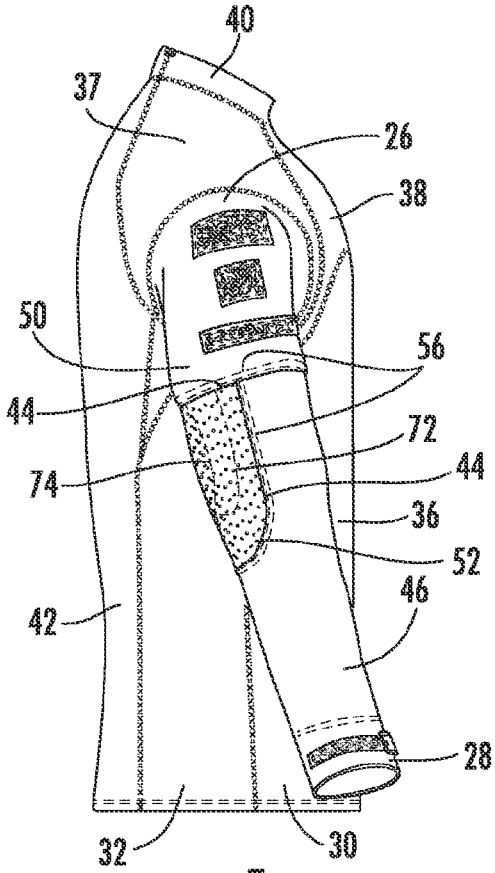
FIG. 5 is a right side view of the garment of FIG. 1.
Figure 6:
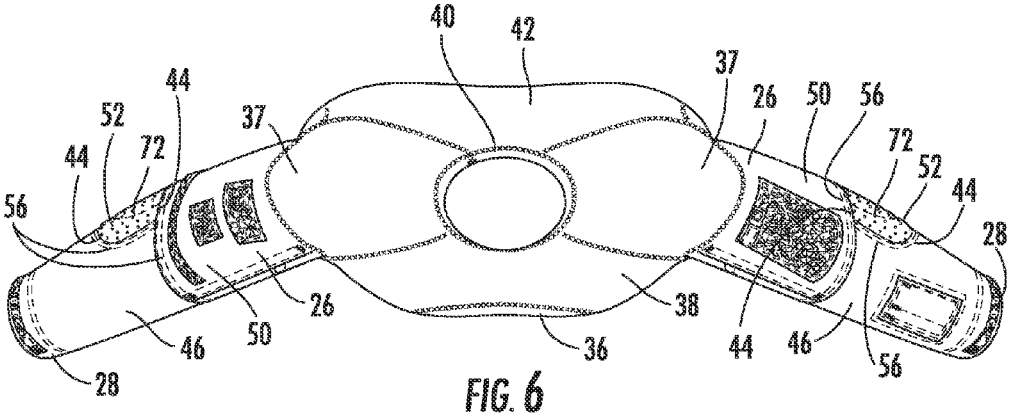
FIG. 6 is a top view of the garment of FIG. 1.
Figure 7:
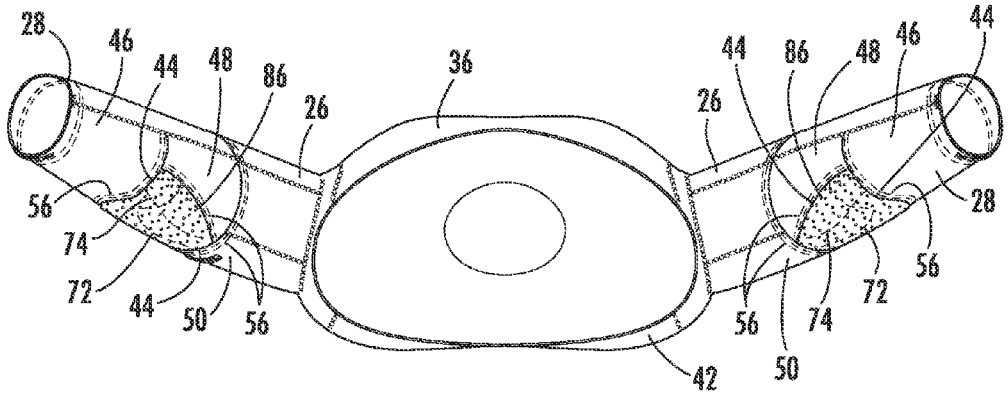
FIG. 7 is a bottom view of the garment of FIG. 1.
Figure 8:
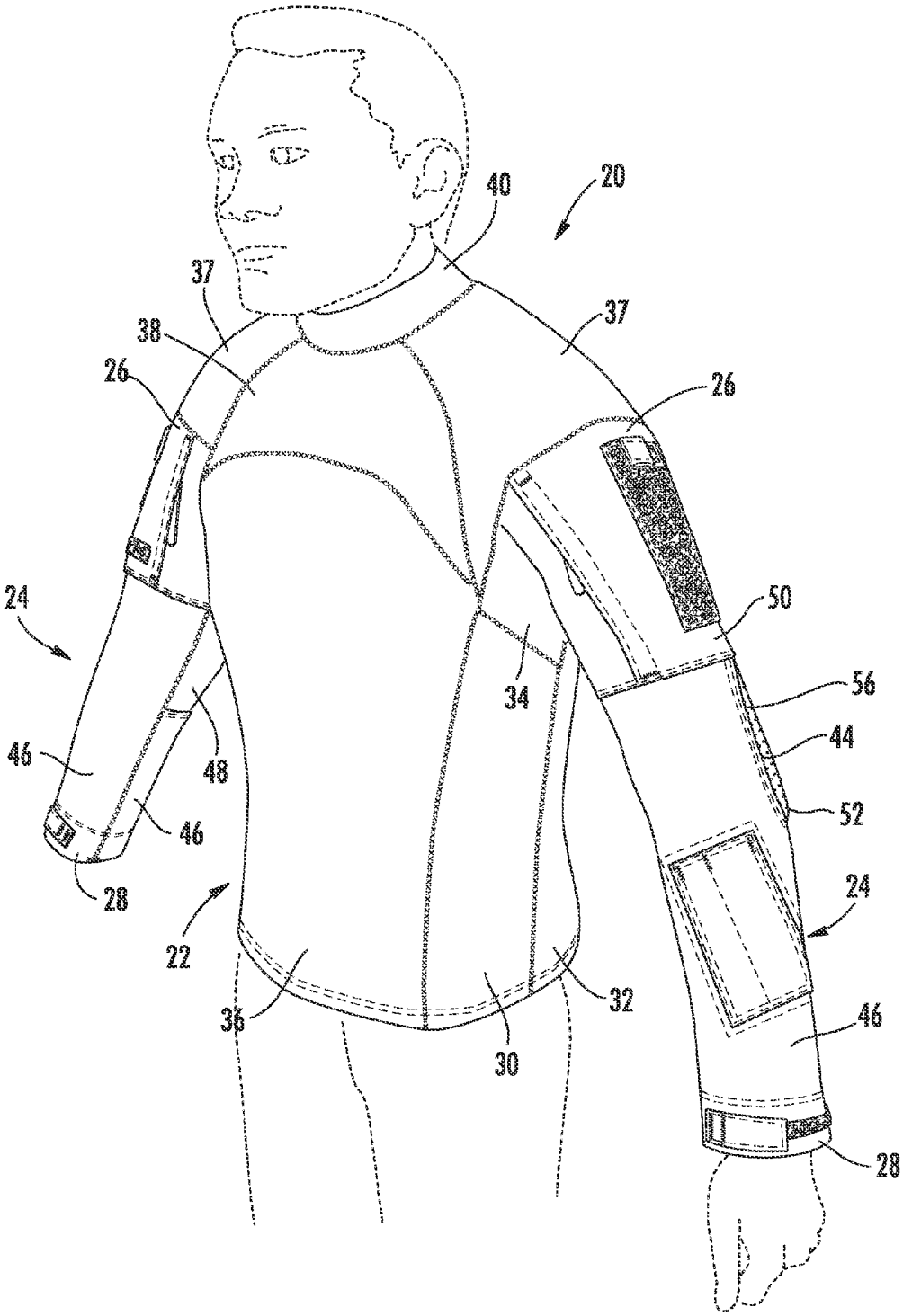
FIG. 8 is a front perspective view of the garment of FIG. 1, as worn.

As shown, each sleeve portion 24 includes an opening 44 therethrough between the shoulder end 26 and the wrist end 28 (see FIG. 3). Openings 44 may be defined by multiple fabric sections on sleeves 24. For example, an opening 44 may be formed by edges of the sleeve sections 46,48,50, although it would be possible to employ more or fewer sections if desired for reasons such as wearability, comfort, functionality (such as pocket location), manufacturing ease, etc. Fabric sections 46, 48, 50 may comprise the same type of fabric or different types of fabric.

Figure 11:
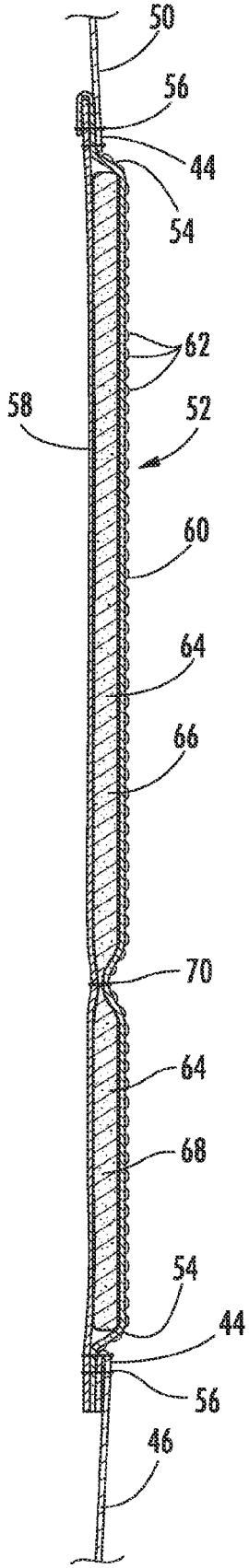
FIG. 11 is a sectional view of an elbow area of the garment of FIG. 1 taken along line 11-11 in FIG. 9.

Elbow pads 52 are located in each opening 44 in sleeve portions 24. As shown in FIG. 11, elbow pads 52 are attached from an inside portion of the sleeves. That is, openings 44 are defined by edges 54, and elbow pads 52 are slightly larger than the openings and attached beneath the edges. Elbow pads 52 are held in place by stitching 56 surrounding the elbow pads. As shown in FIG. 11, overlapped layers and/or serged stitching may be provided for strength. Such structure provides benefits such as a low profile allowing for less abrasion damage during wear. Elbow pads 52 fill openings 44 from the inside as illustrated, but it should be understood that the elbow pads could be attached in other ways, such as to an inner or an outer sleeve surface, with or without any opening.

As shown, elbow pads 52 are formed from padding material and have three layers, although other numbers of layers are possible. Inner layer 58 may be formed of the same material as the remainder of sleeve portion 24, or if desired, torso portion 22. Breathability, moisture management, and/or comfort of the wearer are concerns for selecting this fabric. If desired, a brushed tricot or jersey knit for example may be employed for inner layer 58. Outer layer 60 may also be the same material.

However, if desired, outer later 60 may be a stronger fabric, having abrasion resistance and cut and tear resistance. Therefore a nylon canvas type material or a twill with or without stretch properties could be employed for example for outer layer 60.

Outer layer 60 may also be reinforced in various ways, such as by use of a coating. Such reinforcement could comprise a continuous or discontinuous polymer coating. As shown, a pattern of polymer dots 62 is applied to the outer surface of outer layer 60. Such dots may comprise a material such as a thermoplastic polyurethane (TPU), although other materials and patterns could be employed for reinforcement, or no reinforcement could be used if desired. Use of a discontinuous reinforcement allows for the benefits of the fabric in terms of stretchability, breathability, fire-resistance, etc., discussed above to be present at the elbow pad, while the discontinuous coating provides additional desired benefits of strength and abrasion resistance without meaningfully degrading the benefits of the fabric.

As shown, padding may be provided by an intermediate layer 64. Layer 64 may be formed in a single piece with two sides 66,68, separated by preferential fold stitching 70. If desired, intermediate layer 64 may comprise a closed cell foam or an open cell foam such as urethane, polyurethane or other materials. Use of open cell foam allows elbow pad 52 to be breathable throughout, as compared to closed cell foam or some other material. Alternatively, a spacer mesh type product or any other type of padding material could be used. If desired, the intermediate layer may provide shock attenuation, shock resistance, and/or stability for use by a wearer when the arm is extended for shooting. If desired, the stitching, fabric, and padding can be dimensioned and tensioned so that the elbow pad is slightly convex in an outer direction complimentary to the elbow shape whether or not the wearer's elbow is bent (See FIG. 9). Intermediate layer 64 could be formed of multiple pieces or multiple sub-layers, if desired. Further, different layers of similar or different materials could be bonded together forming a single piece or layer, if desired. Intermediate layer 64 or other layers 58,60 may be fire or flame resistant if desired. Accordingly, coatings such as phosphorus compounds, halogen compounds such as bromine with a binder, or the like may be employed. Suitable known compounds meeting Underwriters Laboratories fire resistance specification UL 94 HF-1 could be used, available from various suppliers, to coat one or more of such layers.

Figure 9:
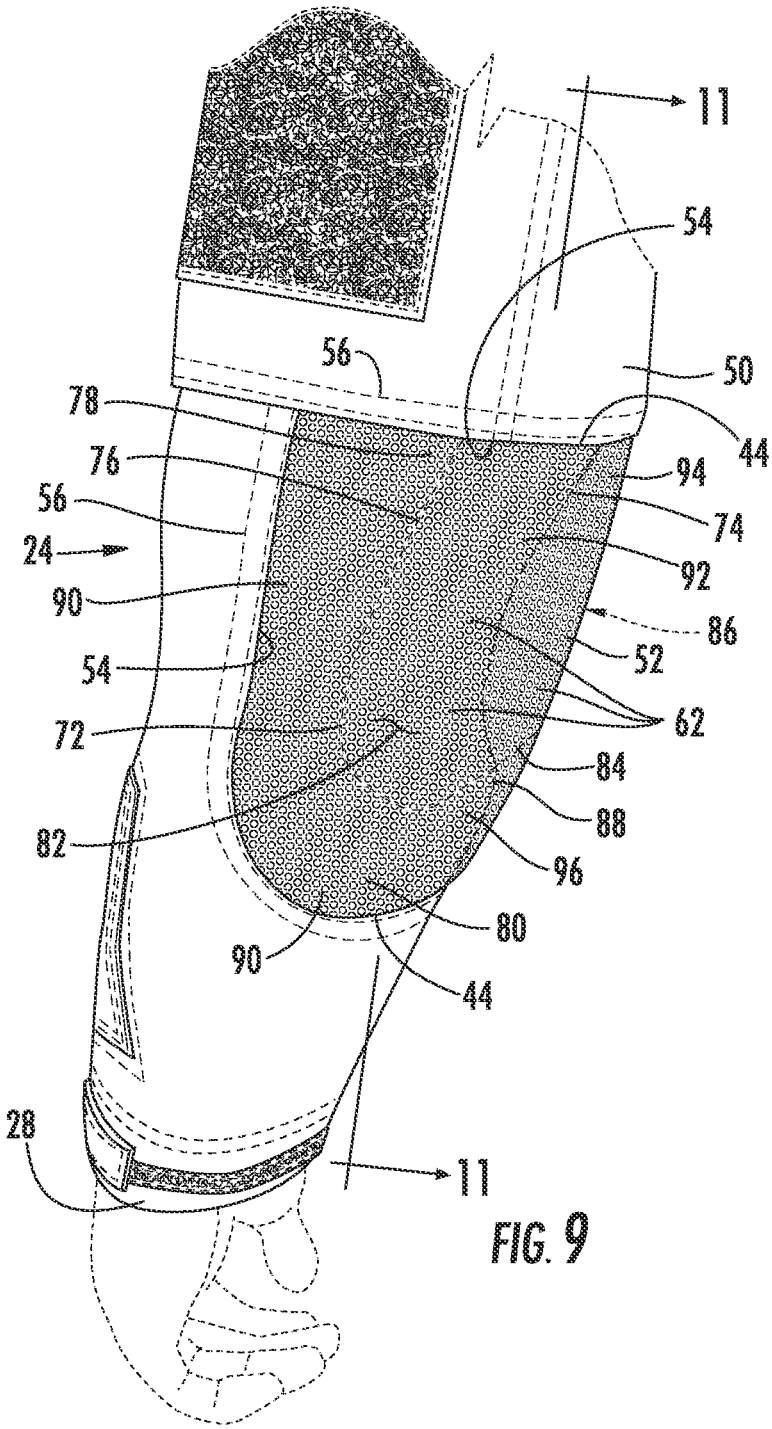
FIG. 9 is a rear perspective view of a portion of the garment of FIG. 1 as worn with the wearer's elbow straightened.
Figure 10:
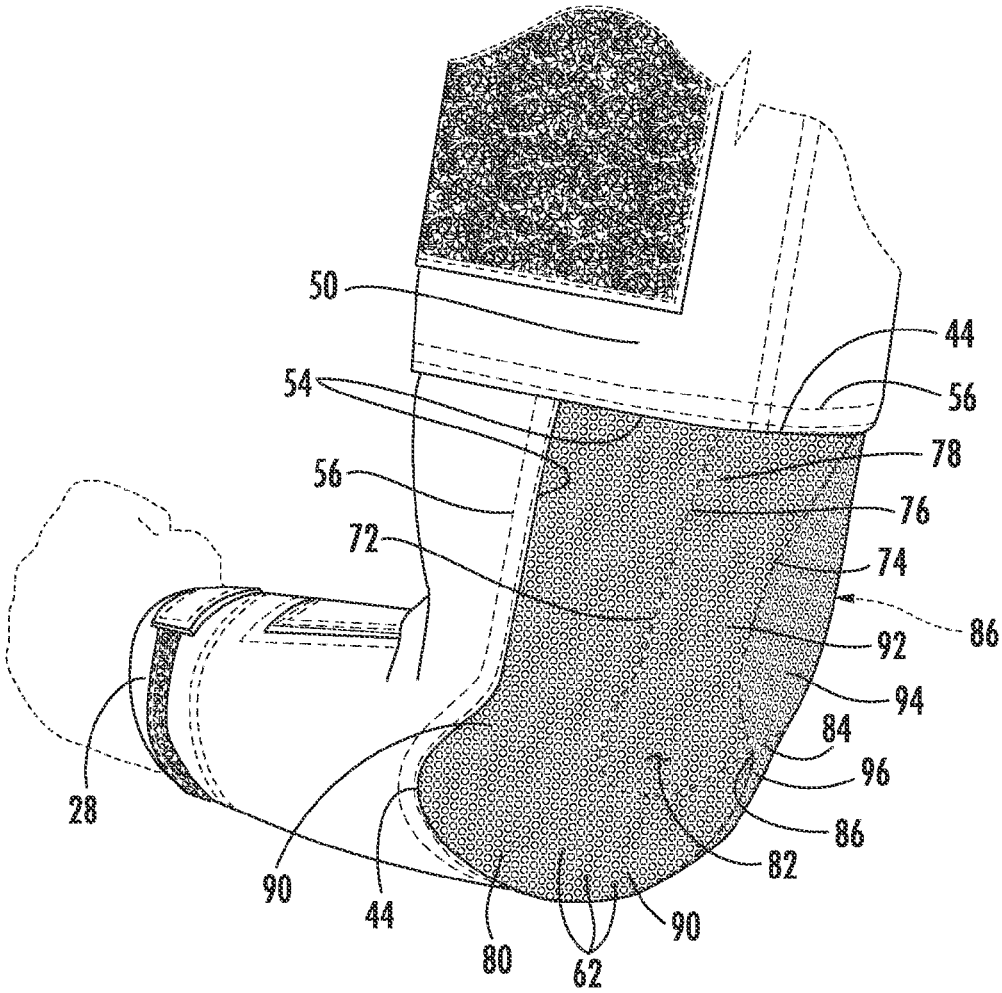
FIG. 10 is a rear perspective view of a portion of the garment of FIG. 1 as worn with the wearer's elbow bent.

As shown in FIGS. 3, 9, and 10, at least one preferential fold line 72 may be formed in elbow pad 52. If desired, more preferential fold lines may be provided, for example by second preferential fold line 74. Preferential fold lines 72,74 may allow for wearer comfort when the arm is extended or bent. Fold lines 72,74 can help locate elbow pad 52 at the elbow for comfort and protection when the arm is bent. During bending in particular, the fold lines 72,74 help form a cup shape and locate the pad at the proper spot to protect the elbow, both in the longitudinal (wrist-shoulder) direction, and circumferentially around the arm. However, even when the arm is extended, the fold lines help cup the elbow pad slightly to position it at the elbow, either alone or in combination with the slight convex pad shape as mentioned above. Thus, the preferential fold lines can be used to assist in forming a slight convex shape when the arm is extended.

As shown, preferential fold line 72 is substantially J-shaped and has a first section 76 that extends from a first end 78 of elbow pad 52 facing shoulder end 26 of sleeve portion 24 toward a second end 80 of the elbow pad facing wrist end 28 of the sleeve portion. The preferential fold line 72 curves in a central area 82 of elbow pad 52 and has a second section 84 extending to a forward side 86 of the elbow pad. As shown in FIG. 10, preferential fold line 72 is configured so that, when a wearer bends an elbow, elbow pad 52 bends along the preferential fold line to cup the elbow.

Second preferential fold line 74 extends from first end 78 of elbow pad 52 to second end 80 of the elbow pad and crosses second section 84 of first preferential fold line 72 at a point 88. Second preferential fold line 74 is configured to cooperate with first preferential fold line 72 to further cup the elbow when the wearer bends the elbow. As shown, both preferential fold lines 72,74 are substantially curved. By using a J-shaped first preferential fold line 72, above the elbow, there are three pad sections 90,92,94 and below the elbow there are two pad sections 90,96 (note that section 90 curves around in a J-shape). This combination of shapes, separated by preferential fold lines 72,74 provides an effectively flexible while still protective cover to the wearer's elbow, whether straightened or bent. Further, the combination of preferential fold lines 72,74 effectively locates the pad at the elbow when straightened or bent, as opposed to having the pad slide to one side or the other, or up or down the arm.

It should be understood that modifications to the design, placement, and/or garment choice, as well as combinations or sub-combinations of the features mentioned above, are possible within the scope of the present invention. Therefore, use of elbow pads having differing shapes for preferential fold lines, or only one preferential fold line, or more than two preferential fold lines, is possible, whether or not the pad underlies the sleeve opening edge. Also, different materials may be employed than the examples mentioned above for all pieces, coatings, etc.

This written description uses examples to disclose aspects of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

We claim:

1. An elbow pad for an upper body garment with a sleeve portion having a shoulder end and a wrist end, the elbow pad comprising:

padding material configured in an elbow pad shape;

a substantially J-shaped preferential fold line, the preferential fold line having a first section extending from a first end of the padding material for placement facing the shoulder end toward a second end of the padding material for placement facing the wrist end, the preferential fold line curving in a central area of the padding material and having a second section extending to a forward side of the padding material, the preferential fold line configured so that the padding material bends along the preferential fold line to cup the wearer's elbow; and wherein the preferential fold line comprises a first preferential fold line and further including a second preferential fold line, the second preferential fold line extending from a first end of the padding material to the second end of the padding material and crossing the second section of the first preferential fold line, the second preferential fold line configured to further cup the wearer's elbow.

2. The elbow pad of claim 1, wherein the preferential fold line is formed in part by stitching penetrating the padding material.

3. The elbow pad of claim 1, wherein the padding material has a convex shape extending outward in the central area.

4. The elbow pad of claim 1, wherein the padding material has an inner layer, an intermediate layer, and an outer abrasion resistant layer.

5. The elbow pad of claim 4, wherein the intermediate layer of the padding material is an open cell foam.

6. The elbow pad of claim 4, wherein at least one of the padding material layers is permeable by at least one of air or moisture.

7. The elbow pad of claim 4, wherein the padding material layers are attached together in a non-planar, cupped orientation so as to enhance a convex shape.

8. The elbow pad of claim 4, wherein at least one of the padding material layers is at least one of flame resistant or fire resistant.

9. An upper body garment with reinforcement for a wearer's elbow, the garment comprising:

a torso portion;

two sleeve portions, each sleeve portion having a shoulder end attached to the torso portion and a wrist end extending distally from the shoulder end, each sleeve portion being formed of a sleeve material in a substantially tubular shape, the sleeve material defining a location for the wearer's elbow; and two elbow pads, each elbow pad being attached to a respective sleeve portion at the location for the wearer's elbow, the elbow pad having a substantially J-shaped preferential fold line, the preferential fold line having a first section extending from a first end of the elbow pad facing the shoulder end of the sleeve portion toward a second end of the elbow pad facing the wrist end of the sleeve portion, the preferential fold line curving in a central area of the elbow pad and having a second section extending to a forward side of the elbow pad, the preferential fold line configured so that the elbow pad bends along the preferential fold line to cup the wearer's elbow, the preferential fold line comprising a first preferential fold line, each elbow pad further including, a second preferential fold line. the second preferential fold line extending from a first end of the elbow pad to the second end of the elbow pad and crossing the second section of the first preferential fold line, the second preferential fold line configured to further cup the wearer's elbow.

10. The garment of claim 9, wherein the preferential fold line is formed in part by stitching penetrating the elbow pad.

11. The garment of claim 9, wherein the elbow pad has a convex shape extending outward in the central area.

12. The garment of claim 9, wherein the sleeve material defines an opening at the elbow location and the elbow pad is sized larger than the opening, the opening defined by edges extending circumferentially around the opening, the elbow pad being attached to the sleeve portion underneath the edges so as to fill the opening with the elbow pad.

13. The garment of claim 12, wherein the elbow pad is attached to the sleeve portion underneath the opening in a non-planar, cupped orientation so as to enhance a convex shape.

14. The garment of claim 9, where each elbow pad includes an inner layer, an intermediate layer, and an outer abrasion resistant layer.

15. The garment of claim 14, wherein at least one of the layers of each elbow pad is permeable by at least one of air or moisture.

16. The garment of claim 14, wherein the intermediate layer of each elbow pad is an open cell foam.

17. The garment of claim 14, wherein the elbow pad layers are attached together in a non-planar, cupped orientation so as to enhance a convex shape.

18. The garment of claim 14, wherein at least one of the elbow pad layers is at least one of flame resistant or fire resistant.

* * * * *